US006256822B1

(12) United States Patent
Weston et al.

(10) Patent No.: US 6,256,822 B1
(45) Date of Patent: Jul. 10, 2001

(54) PATIENT SUPPORT SYSTEM WITH SIDE BOLSTER FEATURES

(75) Inventors: Russell J. Weston, Greer; Joseph A. Benedict, Mauldin, both of SC (US)

(73) Assignee: Span-America Medical Systems, Inc., Greenville, SC (US)

( * ) Notice: Subject to any disclaimer, the term of this patent is extended or adjusted under 35 U.S.C. 154(b) by 0 days.

(21) Appl. No.: 09/494,335

(22) Filed: Jan. 28, 2000

Related U.S. Application Data

(60) Provisional application No. 60/117,744, filed on Jan. 29, 1999.

(51) Int. Cl.[7] ..... A47C 27/16

(52) U.S. Cl. ..... 5/732; 5/731; 5/736; 5/738; 5/739; 5/740

(58) Field of Search ..... 5/699, 731, 732, 5/733, 734, 735, 736, 737, 738, 739, 740, 490, 900.5, 901

(56) References Cited

U.S. PATENT DOCUMENTS

D. 326,976 6/1992 Wickis, Jr. et al. .
D. 355,488 2/1995 Hargest et al. .

(List continued on next page.)

FOREIGN PATENT DOCUMENTS

2646772A1 * 11/1990 (FR) ..... 5/736
2163951A * 3/1986 (GB) ..... 5/732

OTHER PUBLICATIONS

"NestCare Ultipedic" Brochure (3 pages—undated) by NestCare, a division of Nature's Nest, Inc., Atlanta, Georgia.*

"Saf–T–Side Raised Edge Mattresses" Brochure (1 page—1998 Copyright date) by Medline Industries, Inc., Mundelein, IL.*

(List continued on next page.)

*Primary Examiner*—Michael F. Trettel
(74) *Attorney, Agent, or Firm*—Dority & Manning

(57) ABSTRACT

A patient support system is provided with side bolster features for improved patient safety and control. A multi component mattress includes a resilient foam core having associated therewith two side bolsters of a less compressible resilient material. Each side bolster forms two peaks with a saddle therebetween to prevent a patient from rolling off the mattress while still providing direct entry and exit access to the mattress. A foam topper may be applied across the top of the exposed core and the upper portion of the side bolsters. Such topper may include parallel ridges, as well as perpendicular segmentations to improve pressure dispersion. The total coverage topper or upper layer surface adds to usable patient support area for the mattress while otherwise minimizing the pressure from the less compressible bolster elements.

20 Claims, 4 Drawing Sheets

U.S. PATENT DOCUMENTS

| | | | | |
|---|---|---|---|---|
| D. 374,368 | | 10/1996 | Sprigle et al. . | |
| D. 390,404 | | 2/1998 | Hargest et al. . | |
| 3,938,205 | | 2/1976 | Spann . | |
| 4,214,326 | | 7/1980 | Spann . | |
| 4,233,700 | | 11/1980 | Spann . | |
| 4,286,344 | * | 9/1981 | Ikeda | 5/732 X |
| 4,706,313 | * | 11/1987 | Murphy | 5/737 X |
| 4,862,538 | | 9/1989 | Spann et al. . | |
| 4,975,996 | * | 12/1990 | Evans et al. | 5/731 |
| 5,007,123 | * | 4/1991 | Salyards | 5/699 |
| 5,025,519 | | 6/1991 | Spann et al. . | |
| 5,090,074 | * | 2/1992 | Scales et al. | 5/699 |
| 5,224,226 | * | 7/1993 | Groenewald | 5/733 |
| 5,252,278 | | 10/1993 | Spann et al. . | |
| 5,387,177 | | 2/1995 | Dunn . | |
| 5,580,504 | | 12/1996 | Spann et al. . | |
| 5,754,998 | | 5/1998 | Selton . | |

OTHER PUBLICATIONS

"NestCare Ultipedic" Brochure (3 pages—undated) by NestCare, a division of Nature's Nest, Inc., Atlanta, Georgia.

"Saf–T–Side Raised Edge Mattresses"Brochure (1 Page—1998 Copyright date) by Medline Industries, Inc., Mundelein, IL.

"UltraForm DPM" Brochure (1 page—undated) by American Health Systems, Inc., South Carolina.

"The Comfortex System" Brochure (1 page—undated) by Comfortex, Inc.

"RoyalMed Pressure Reduction Mattress" Sales Advertisement (1 pages—undated) by B.G. Industries, Inc., Northridge, CA.

"Quest Medical Supply—MaxiGuard BCS" Brochure (2 pages—earliest date Sep. 12, 1997) by B.G. Industries, Inc., Northridge, CA.

"Joerns Foam Mattress Series" Brochure (1 page—undated) by Joerns.

* cited by examiner

PATIENT SUPPORT SYSTEM WITH SIDE BOLSTER FEATURES

PRIORITY CLAIM

Priority is hereby claimed to previous filed U.S. provisional application with the same title and inventors as present, assigned U.S. Ser. No. 60/117,744, filed Jan. 29, 1999.

BACKGROUND OF THE INVENTION

The present invention generally relates to improved patient support systems and more particularly concerns patient support systems with side bolster features for greater patient safety and control.

Various contoured support surfaces have long been known in the therapeutic patient support field. Some examples of patient support surfaces having plural zones of various support characteristics are shown by commonly owned patents, U.S. Pat. Nos. 4,862,538; 5,025,519; 5,252,278 and 5,580,504.

It is known in the patient support field to provide certain additional features to basic support, such as for aiding and aligning a patient's body on a support surface or otherwise supporting various limbs, such as legs, arms, or a patient's head. Examples of certain alignment devices are shown by commonly owned patents, U.S. Pat. Nos. 3,938,205; 4,233,700; Design Pat. No. D326,976; and Design Pat. No. D355,488. Commonly owned U.S. Pat. No. 4,214,326 includes also a protection apparatus, comprising a cushioning element for residing on the side frame of a hospital bed or the like.

Commonly owned U.S. Pat. No. 5,387,177 discloses an adjustable pediatric incubator nest having foam sidewall members for forming a cradle for the pediatric patient, such as an infant in an intensive care environment. Commonly owned U.S. Design Pat. No. D390,404 discloses a head cradle, likewise having curved side elements for cradling a patient's head. Commonly owned U.S. Design Pat. No. D374,368 discloses a modular back rest unit, having movable side elements for lateral support of a patient's back in an upright position, such as when a patient is seated in a wheelchair.

Another type of mattress pad disclosed in U.S. Pat. No. 5,754,998 is a mattress pad with unitary construction with elevated curved ridges on the sleeping surface so that the sleeper has support for legs or back while sleeping. Such disclosure specifies that the curved ridges should intrude into the sleeping area so as to provide the most support.

The complete disclosures of all of the above-referenced United States Patents are hereby fully incorporated herein by reference.

SUMMARY OF THE INVENTION

The present invention recognizes and addresses various of the limitations and problems concerning the safety and control of patients received on therapeutic support surfaces. Thus, broadly speaking, a principal object of this invention is an improved patient support system. More particularly, a main concern is improved safety and control of a patient received on a therapeutic patient support surface.

It is another present object to provide a therapeutic patient support surface with side bolster features which continue to facilitate desired patient ingress and egress under controlled conditions while otherwise aiding retention and control of the patient while resting on the therapeutic support surface.

It is another object of the present invention to provide a composite mattress with maximum sleeping area and while having side bolster supports.

It is another object of the present invention to provide a one-time use side bolster mattress wherein the entire surface of the mattress is sleepable mattress space.

It is yet another object of the present invention to provide a mattress with bolster supports with the entire top surface being skin friendly.

Additional objects and advantages of the invention are set forth in, or will be apparent to those of ordinary skill in the art from, the detailed description herein. Also, it should be further appreciated that modifications and variations to the specifically illustrated, referenced and discussed features or materials hereof may be practiced in various embodiments and uses of this invention without departing from the spirit and scope thereof, by virtue of present reference thereto. Such variations may include, but are not limited to, substitution of equivalent means and features or materials for those shown, referenced or discussed, and the functional, operational, or positional reversal of various parts, or features, or the like.

Still further, it is to be understood that different embodiments, as well as different presently preferred embodiments, of this invention may include various combinations or configurations of presently disclosed features or elements, or their equivalents (including combinations of features or configurations thereof not expressly shown in the figures or stated in the detailed description).

These and other objects of the invention are achieved through the present invention, such as with an exemplary composite mattress. Such exemplary composite mattress may have preferably at least a three-part construction or its equivalents. A mattress core made of resilient material provides a main element of therapeutic patient support. Two bolsters, made of a resilient material which is generally less compressible than the mattress core, are attached to the sides of the core mattress. Each bolster forms two peaks and a saddle therebetween to prevent a patient from rolling off the mattress while still providing deliberate and easy access into and out either side of the mattress. In some alternate embodiments, a saddle on only a single side may be practiced instead. The third component of such exemplary mattress may comprise a topper. One exemplary topper may have a plurality of generally parallel ridges running perpendicular to the longitudinal axis of the mattress. Each of such ridges may optionally contain at least one segment formed by generally perpendicular cuts through the ridges. The topper is affixed to the mattress core and the bolsters or supported thereby so that the entire surface of the mattress has a therapeutic effect.

Another exemplary embodiment in accordance with the subject invention relates to an improved patient support system having a main mattress core and first and second side bolsters. In such exemplary embodiment, the main mattress core is generally rectangular and includes resilient foamed material. The mattress core is preferably formed to have lengthwise longitudinal sides and an upper support surface. In such embodiment, the first and second side bolsters are comprised of resilient foam material which is generally less compressible than that of the main mattress core. Such side bolsters are preferably attached to respective of the mattress core longitudinal sides so as to project vertically above the upper support surface of the mattress core for guiding a patient from rolling off of the patient support system. Further in accordance with such exemplary embodiment, preferably at least one of the side bolsters forms a relative central trough by which a patient may more readily egress and ingress the patient support system under controlled conditions.

The accompanying drawings, which are incorporated herein and constitute a part of the specification, illustrate one or more embodiments of the invention, and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1A:
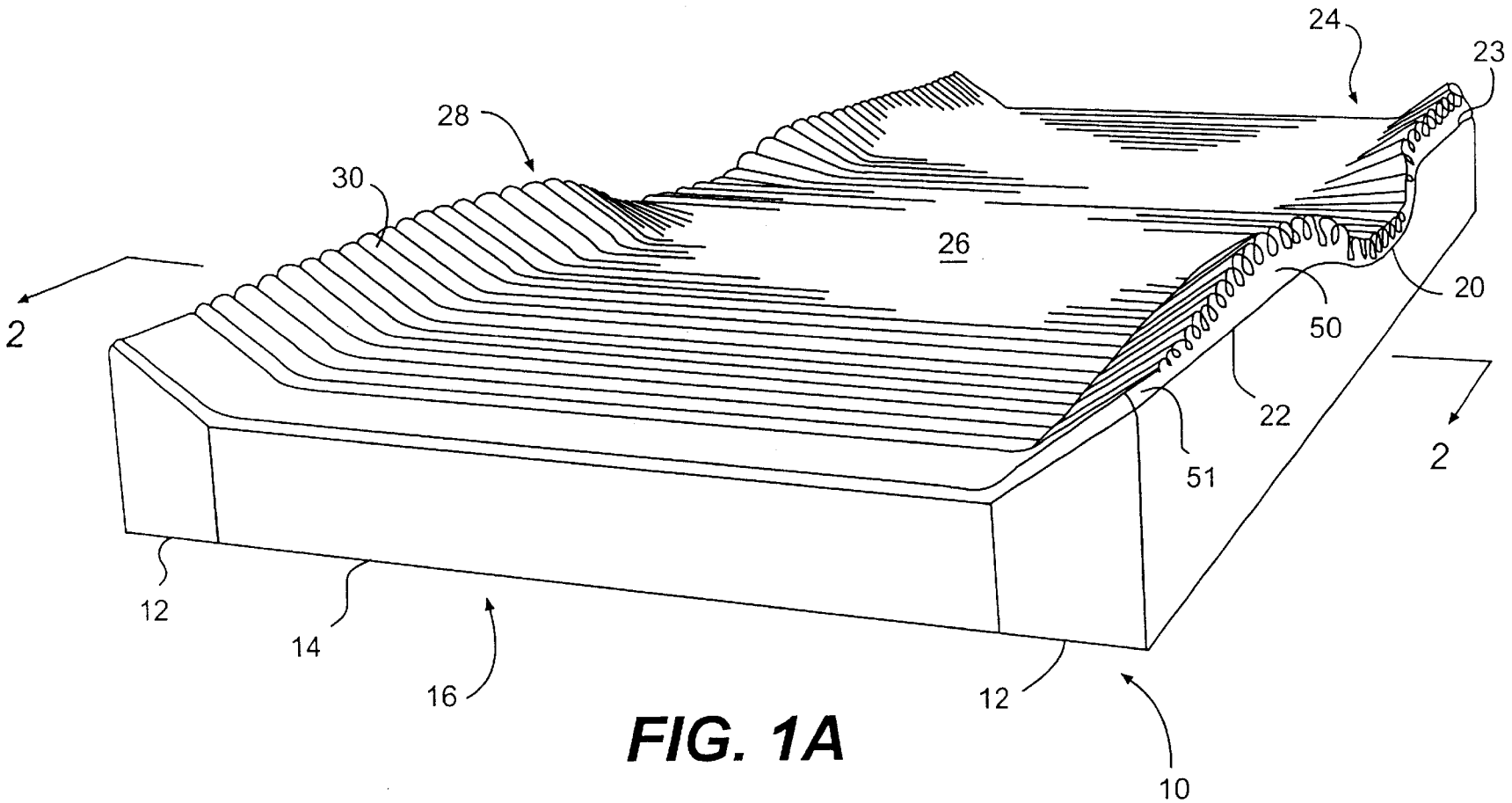
FIG. 1A is a perspective view from the foot of the mattress of an exemplary preferred embodiment of the invention.

Repeat use of reference characters in the present specification and drawings is intended to represent same or analogous features or elements of the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those of ordinary skill in the art that modifications and variations can be made in the present invention without departing from the scope and spirit thereof. For instance, features illustrated or described as part of one embodiment may be used on another embodiment to yield a still further embodiment. Thus, it is intended that the present invention cover such modifications and variations as come within the scope of the present disclosure and their equivalents.

Figure 2:
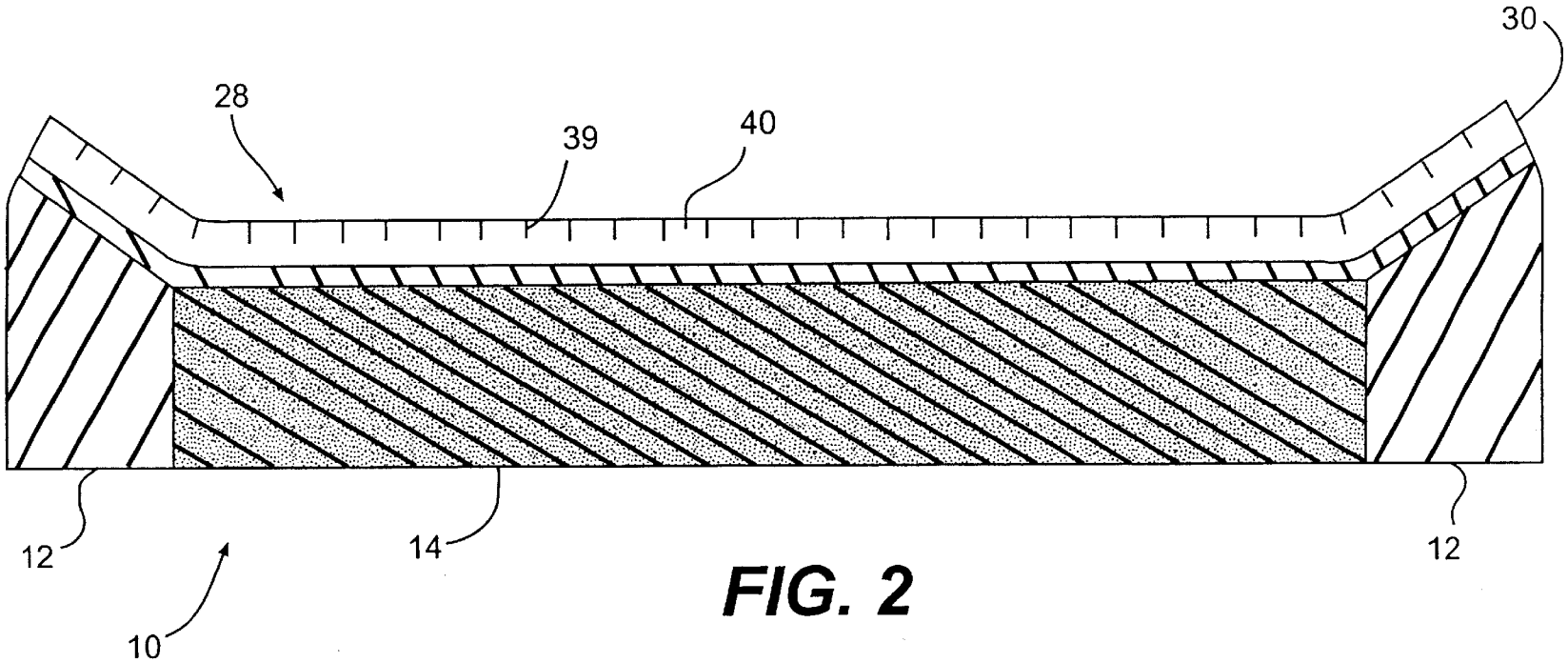
FIG. 2 is a cross-sectional view taken along line 2—2 of FIG. 1A of the exemplary preferred embodiment of the invention.

As shown in FIG. 1A, mattress 10 has two ends. A first end is foot 16. The other end is head 24. The components of mattress 10 are shown in FIGS. 1A and 2 which illustrate three different types of pieces that may be utilized in an exemplary mattress 10 construction. The multi-component mattress has high-density bolsters 12 bonded to a dual layer progressive resistance support surface. By constructing in such manner, a preferred combination of comfort, support and durability is achieved.

Mattress core 14 is a resilient piece of material (such as resilient foam) which forms the main basis of the mattress 10. Mattress core 14 is preferably shaped as a solid rectangular box with generally squared corners and planed surfaces for ease of construction.

Running between head 24 and foot 16 of mattress 10 are attached two bolsters 12. One bolster 12 is attached to each of opposing sides of mattress core 14. Bolsters 12 are preferably symmetrical and composed of a resilient material which is less compressible than mattress core 14. Preferably each bolster 12 is shaped in an easy to manufacture shape, but may be configured more generally in any polygonal shape. As shown in FIG. 2, each bolster 12 is preferably shaped to approximate a trapezoid at both the head 24 and foot 16. Each bolster 12 creates a head ridge 23 and a foot ridge 22. In the middle of bolster 12, as shown in FIG. 1A, is a saddle 20 between head ridge 23 and foot ridge 22. A resulting saddle 20 is preferably constructed on each side of the mattress so as to be generally lower than head ridge 23 and foot ridge 22. In some embodiments, a single saddle may be practiced.

Topper 28 preferably covers the entire top area from the foot 16 to head 24 and from foot ridge 22 and head ridge 23 on one side to the corresponding head and foot ridges 22 and 23 on the opposite side of mattress 10, covering the entire top surface area of mattress 10. Topper 28 may have a plurality of generally parallel ridges 30 running generally perpendicular to the longitudinal direction of mattress 14. In a preferred embodiment of the invention, each ridge is individually shaped so that compression of one ridge does not interfere with the support given by another ridge. The material of topper 28 is a tissue friendly material, such as resilient foam. This means that the topper will help reduce the frequency, duration, and/or severity of bed sores and lesions appearing on the skin of a patient due to long periods of confinement of such patient to mattress 10.

Figure 1B:
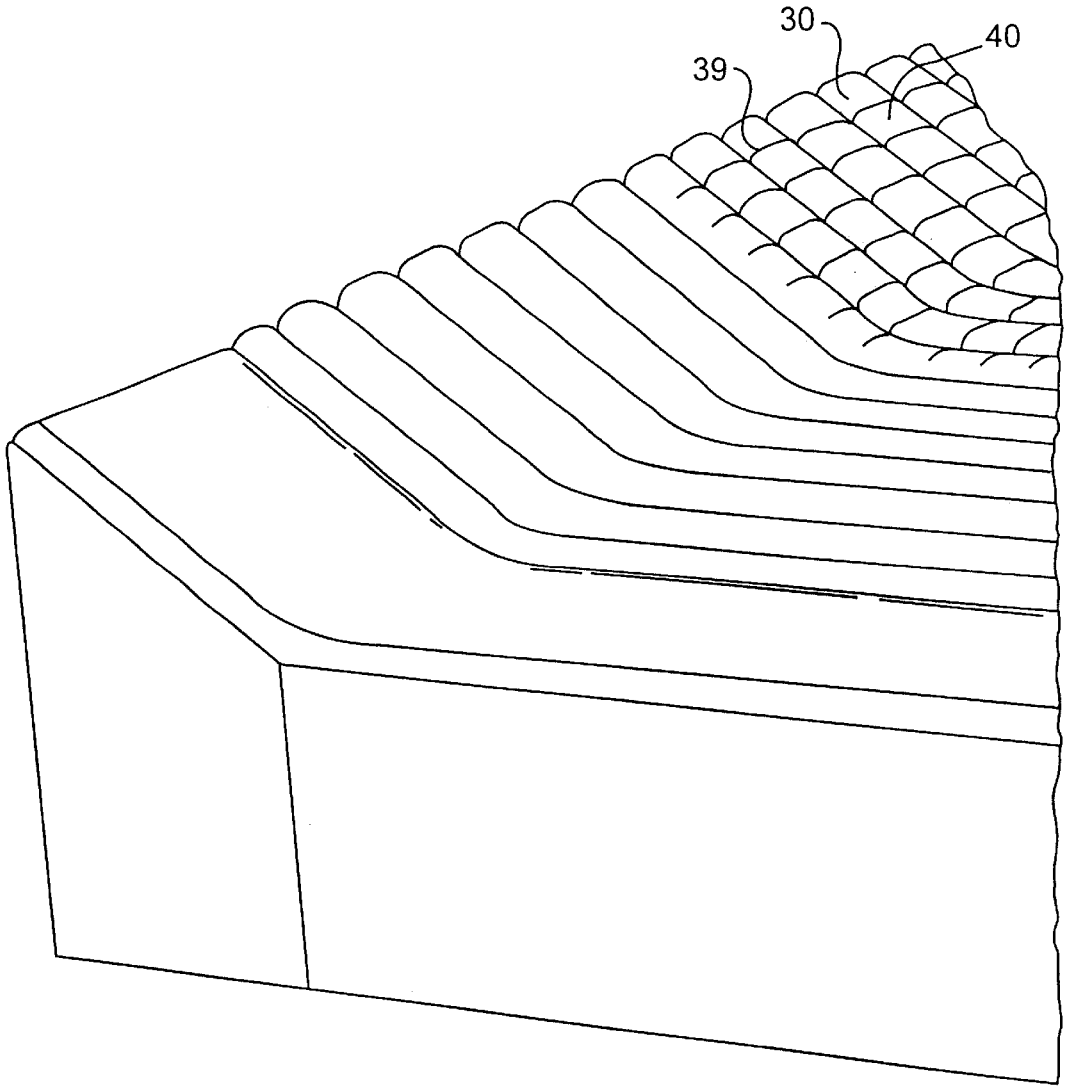
FIG. 1B is a partial enlargement of the perspective view of the exemplary preferred embodiment of the invention as shown in present FIG. 1.

Surface 26 of topper 28 may also have segments in ridges 30. As shown in FIG. 1B, cuts 39 subdivide a plurality of ridges 30 into a plurality of segments 40 so that when one segment 40 is compressed such as by a bony protuberance, adjacent segments will generally be unaffected by the compression. Such construction provides specific therapeutic benefits to the patient lying on mattress 10 because the remainder of segments 40 not affected by the bony protuberance will better support the remainder of the body.

Topper 40 is divided in the illustrated example into three distinct sections, use of which (or other types or numbers of special zones) is completely optional in various embodiments. At head 24 ridges 30 of surface 26 may be smaller than ridges of the topper of saddle section 20. The effect of such an arrangement is to provide better support to the head. The greater contours of the head region of the body are a result of more ridges than the torso region of the body.

In one preferred embodiment of the invention, foot 22 of topper 28 creates a sloping heel feature wherein the thickness of the topper at a top 50 above the sloping heel area is thicker than the topper at the bottom 51 adjacent sloping heel area. As the topper approaches the end of the mattress at foot 16, the thickness of the topper 28 preferably diminishes. The tapered or sloping heel section redistributes the load more safely from the heels onto the more pressure tolerant lower legs and calves, thus reducing the incidence of bed sores on a patient.

Figure 3:
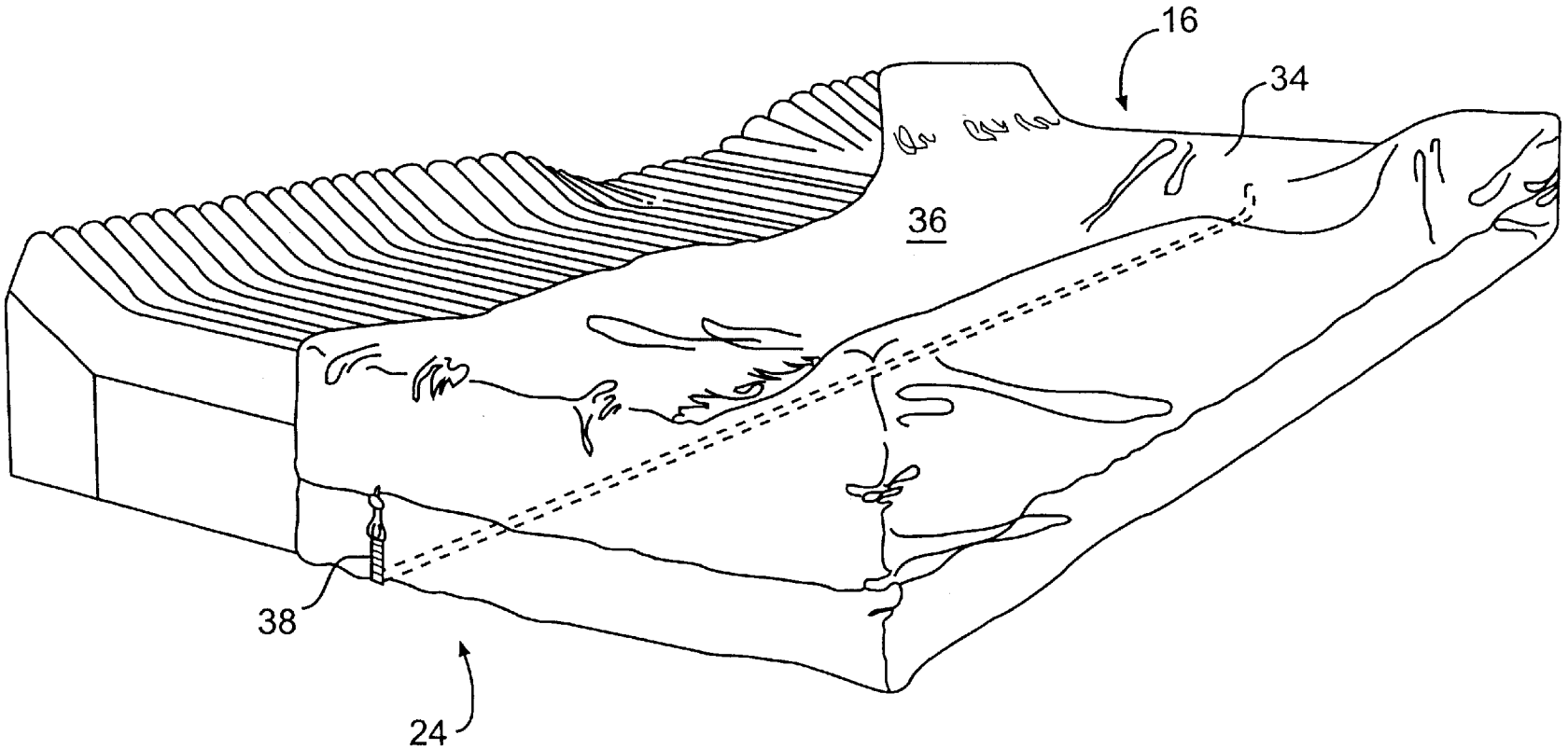
FIG. 3 is a perspective view from the head of the mattress of the exemplary preferred embodiment of the invention with a cover thereof partially cut away.

In another preferred embodiment of the invention, the entire mattress 10 is enclosed in a cover 34, as shown in FIG. 3. Cover 34 may have a centrally located zipper 38 which zips open and closed between the foot and the head across the bottom side of the mattress. Cover 34 is preferably constructed so that there is enough fabric across the top of the mattress so that there is no hammocking effect. To facilitate construction of such cover 34, one preferred embodiment uses at least a two part cover construction. Cover surface 36 is preferably anti-microbial and may also have waterproof backing to protect the mattress from moisture. The central zipper 38 is positioned along the back side of the mattress over the length of the bottom (i.e., under) side of cover 34. The zipper is preferably positioned there so as to help keep fluids away from the interior of the mattress 10.

The mattress 10 and cover 34 are preferably bacteriostatically-treated to prevent bacterial growth. Both the mattress 10 and cover 34 are flame resistant. The mattress also uses standard bed linens.

Mattress 10 may be made out of a variety of materials. The preferred embodiment is foam. The use of foam makes the mattress fully articulatable to any standard bed frame and facilitates its production in a variety of sizes. In one preferred embodiment of the invention, the foam used to make the mattress core may have a density range preferably of about 1.5 to about 2.1 pounds per cubic foot. One preferred embodiment of the invention more particularly uses a density of about 1.8 pounds per cubic foot. The 25% ILD range for the mattress core is preferably from about 31 to about 37 pounds of force with about 34 pounds of force being one specific preferred value. ILD stands for Indentation Load Deflection, as known in the industry, and means the amount of force in pounds it takes to push a 50 square inch circular plate into the subject body a given percentage distance of its non-loaded thickness (eg., such as 25% for a 25% ILD rating).

The bolsters are constructed with foam of a density of a preferred range of about 1.4 to about 2.0 pounds per cubic foot with a preferred density of about 1.7 pounds per cubic foot. The 25% ILD range for the bolsters in a preferred embodiment is about 72 to about 78 pounds of force with one preferred value of about 75 pounds of force. The topper is constructed of a foam with a density range of about 2.2 to about 2.8 pounds per cubic foot with a preferred value of density being about 2.5 pounds per cubic foot. The 25% ILD range for the topper is about 28 to about 33 pounds of force with one preferred value of about 30 pounds of force.

The construction of mattress 10 according to various preferred embodiments of the invention results in a maximization of usable bed space. By extending the topper 28 across the mattress core 14 onto bolsters 12, minimal bed space area is lost. Additionally, bolster material 12, in order to best retain a patient in the bed, is made of a stiffer material than core mattress 14. If the bolster 12 is covered in accordance with the invention, the covered bolster 12 will prevent tissue damage to a patient who leans against it, even though constituting a relatively much stiffer support than other support surfaces of the invention. By covering the mattress core 14 and bolsters 12 with a unitary topper 28 the entire top surface of mattress 10 is tissue friendly.

The covering of bolsters 12 with topper 28 also provides the maximum amount of bed space for a patient who is lying on the mattress 10. If, for example, a standard bed has roughly 35 inches of bed width, in order to preserve such full width, the bolster 12 must be covered with the topper 28 or the bolster 28 must extend beyond such 35 inch bed frame. If the latter option is chosen, the bolsters would have less support, which would tend to defeat the purpose of the bolster to retain a patient in bed. Alternatively, it could require special modifications to the bed which could be expensive. As represented, saddles 20 are also covered by topper 28. Each saddle 20 is a low spot between the ridges of bolster 12 which allows a patient easier access into and out of mattress 10. The low space is ideal for sitting while putting on slippers or positioning oneself to stand up or to be transferred to a wheelchair or to assist when entering the bed (by being seated and then essentially rotating to face towards the end of the bed). The topper over saddle 20 ensures that less tissue damage can occur by skin directly contacting the saddle in bolster 12.

While one or more preferred embodiments of the invention have been described above, it should be understood that any and all equivalent realizations of the present invention are included within the scope and spirit thereof. Thus, it should be understood by those of ordinary skill in this art that the present invention is not limited to these embodiments, since modifications can be made. Therefore, it is contemplated that any and all such embodiments are included in the present invention as may fall within the literal or equivalent scope of the disclosure herewith.

What is claimed is:

1. A therapeutic patient support system with integrated side safety bolsters facilitating desired patient ingress and egress under controlled conditions, comprising:

a main mattress core including resilient material forming an upper support surface providing a main element of therapeutic patient support;

a pair of bolsters, comprised of resilient material which is generally less compressible than that of said mattress core, each of said bolsters being attached to a respective longitudinal side of said mattress core, and defining two relative peaks and a saddle therebetween relative to said mattress core upper support surface, to guide a patient from rolling off said patient support system while otherwise facilitating controlled access thereto; and a predetermined topper supported on said mattress core upper support surface and on said bolsters, and comprised of resilient material for providing an entire support surface of said patient support system with a therapeutic effect.

2. A therapeutic support system as in claim 1, wherein said mattress core is generally rectangular and said bolsters are respectively mutually symmetrical.

3. A therapeutic support system as in claim 2, wherein:

each bolster has a generally trapezoid shape at each respective end thereof; and said therapeutic support system further includes a protective covering.

4. A therapeutic support system as in claim 1, wherein:

said topper includes a plurality of respective independent support segments for improved patient pressure dispersion; and said topper includes a tapered heel section for at least partially redistributing pressure from a patient's heels to the patient's legs.

5. A therapeutic support system as in claim 1, further including:

a waterproof, flame-resistant covering around said mattress core, bolsters and topper; and wherein said patient support system is bacteriostatically-treated and said resilient material thereof is flame resistant.

6. A therapeutic support system as in claim 1, wherein:

said mattress core resilient material and said bolsters resilient material has a density generally at least about 1.0 pounds per cubic foot; and the 25% ILD rating of said resilient material of said bolsters is generally higher than that of said mattress core resilient material.

7. A therapeutic support system as in claim 6, wherein said 25% ILD rating of said resilient material of said bolsters is generally at least about twice that of said mattress core resilient material.

8. A therapeutic patient support surface with integrated safety side bolsters which aid retention and control of a patient resting prone on said patient support surface while facilitating desired patient ingress and egress relative thereto when a patient is in a controlled upright position, comprising:

a main mattress core comprising a generally rectangular block of resilient foamed material having relatively square corners and a pair of planar, opposite, elongated side surfaces formed running generally parallel to the longitudinal direction of said mattress core, said mattress core further forming a generally planar upper support surface having respective generally head and foot ends;

a pair of generally mutually symmetrical bolsters, respectively attached to opposite of said mattress core side surfaces and comprising resilient foamed material which is generally less compressible than that of said mattress core, with each bolster shaped to approximate a trapezoid at both respective head and foot ends thereof, and forming respective curved upper surfaces each defining respective head and foot retaining ridges and with a respective centrally located saddle therebetween and formed approximately at the level of said main mattress core upper support surface;

a resilient foamed material topper covering the entirety of said main mattress core upper support surface and of said pair of bolsters curved upper surfaces, said topper having individual support sections for improved patient support; and a water-proof protective cover received over said main mattress core, said bolsters and said topper.

9. A therapeutic patient support surface as in claim 8, wherein said topper includes a tapered heel support section and plural ridges subdividing the upper surface of said topper into plural segments for relatively independent segment support of a patient received thereon.

10. A therapeutic patient support surface as in claim 9, wherein said segments have varying sizes such as to form at least three distinct sections of support corresponding generally with head, central, and feet areas of a patient.

11. A therapeutic patient support surface as in claim 8, wherein:

said main mattress core is comprised of resilient foamed material in a density range generally of from about 1.5 to about 2.1 pounds per cubic feet, and in a 25% ILD rating range generally of from about 31 to about 37 pounds; and said bolsters are comprised of resilient foamed material in a density range generally from about 1.4 to about 2.0 pounds per cubic feet, and in a 25% ILD rating range generally of from about 72 to about 78 pounds.

12. An improved patient support system, comprising:

a generally rectangular main mattress core, including resilient foamed material and forming lengthwise longitudinal sides and an upper support surface; and first and second side bolsters, comprised of resilient foamed material which is generally less compressible than that of said main mattress core, with each of said side bolsters being attached to respective said mattress core longitudinal sides; and a resilient foamed material topper covering the entire upper surfaces of said main mattress core and said side bolsters;

wherein at least one of said side bolsters forms a relative central trough by which a patient may more readily egress and ingress said patient support system under controlled conditions.

13. An improved patient support system as in claim 12, wherein the other of said side bolsters forms a relative central trough to also facilitate patient egress and ingress under controlled conditions.

14. An improved patient support system as in claim 12, wherein said relative central trough has a bottom that is generally level with said main mattress core upper support surface.

15. An improved patient support system as in claim 12, wherein at least one of said side bolsters has approximate trapezoid cross-sectional ends and a curving upper surface forming respective head and foot end ridges with said relative central trough formed therebetween said head and foot end ridges.

16. An improved patient support system as in claim 15, wherein said resilient foamed material of said main mattress core, said side bolsters, and said topper all comprise bacteriostatically-treated, flame-resistant material.

17. An improved patient support system as in claim 16, wherein said topper is subdivided into respective sections of distinct support characteristics for improved patient support.

18. An improved patient support system as in claim 17, wherein said topper includes a tapered section below a patient's heels for redistributing pressure from the heels and more towards a patient's lower legs and calves.

19. An improved patient support system as in claim 18, wherein said patient support system includes a waterproof cover.

20. An improved patient support system as in claim 19, wherein said waterproof cover includes anti-microbial, flame resistant material.

* * * * *